United States Patent [19]

Kolecki

[11] Patent Number: 4,552,003

[45] Date of Patent: Nov. 12, 1985

[54] LUBRICANT REMOVAL SYSTEM FOR A COLD ROLLING MILL

[75] Inventor: Ronald E. Kolecki, Terre Haute, Ind.

[73] Assignee: Atlantic Richfield Company, Denver, Colo.

[21] Appl. No.: 720,456

[22] Filed: Apr. 4, 1985

Related U.S. Application Data

[63] Continuation of Ser. No. 521,050, Aug. 8, 1983, abandoned.

[51] Int. Cl.[4] ..... B21B 9/00; B21B 27/10; B21B 45/02

[52] U.S. Cl. ..... 72/38; 72/201; 72/236

[58] Field of Search ..... 15/306 R, 306 A; 55/237, 261, 266; 72/38, 39, 45, 201, 236; 134/104, 109

[56] References Cited

U.S. PATENT DOCUMENTS

| | | | |
|---|---|---|---|
| 2,914,975 | 12/1959 | Cavanaugh et al. | 72/38 |
| 3,192,752 | 7/1965 | Dowd et al. | 72/45 |
| 3,257,835 | 6/1966 | Cofer et al. | 72/38 |
| 3,488,927 | 1/1970 | Jepsen et al. | 55/237 |
| 3,608,344 | 9/1971 | Schwan | 72/38 |
| 4,400,961 | 8/1983 | Schaming | 72/201 |

*Primary Examiner*—E. Michael Combs

*Attorney, Agent, or Firm*—Allegretti, Newitt, Witcoff & McAndrews, Ltd.

[57] ABSTRACT

An improved lubricant and coolant removal system for a roll stand includes suction boxes surrounding the sheet formed by the roll stand and a series of pipes connecting the suction boxes to various coolant traps. Special doctor blades and air knives remove coolant from the rolls. An enclosing shroud prevents coolant overspray and mist from escaping.

2 Claims, 4 Drawing Figures

LUBRICANT REMOVAL SYSTEM FOR A COLD ROLLING MILL

This application is a continuation, of application Ser. No. 521,050, filed Aug. 8, 1983, abandoned.

BACKGROUND OF THE INVENTION

This invention relates to an improved, cold rolling mill stand, and specifically, to a cold rolling mill stand for rolling nonferrous metal sheet or rod which includes apparatus for removal of coolant (lubricant) from the surface of the rolled product upon exit from the work rolls of the mill stand.

Cold rolling of aluminum sheet, for example, often requires utilization of a coolant which is sprayed on the sheet material during the rolling operation as the sheet enters the rolls prior to reduction. Heretofore, kerosene or mineral seal oil coolants have been used for such rolling processes. Removal of the coolant from the rolled sheet prior to annealing has been a necessary process to avoid burning of the kerosene base coolant. Removal has been effected by a purge step wherein the rolled sheet is heated slightly and large amounts of air are drawn over the heated sheet prior to annealing. The purge step can result in combustion if not carefully controlled.

More recently nonflammable water based coolants have been used during a rolling operation. Such coolants must also be removed quickly and efficiently from the rolled product. Otherwise, the coolant will cause stains on the rolled product.

Thus, it is desirable to remove any coolant from rolled product subsequent to rolling for numerous reasons including reuse of the coolant. Recapture of the coolant also prevents discharge of the coolant into effluent streams, prevents staining of the rolled product and eliminates an air borne health or safety hazard.

Heretofore removal of the liquid coolant was merely effected by collecting the coolant in pans or reservoirs as the coolant overflowed from the rolled product upon exit from the rolling mill. The present invention is directed toward an improved assembly which positively removes coolant from cold rolled sheet or rod.

SUMMARY OF THE INVENTION

Briefly, the present invention comprises an assembly of components in combination with a roll stand for spraying coolant on the product to be rolled and for subsequently removing the coolant from the rolled product. The roll stand is shrounded to enclose an arrangement of various doctor blades, air knives, suction manifolds and coolant nozzles. Coolant is discharged from the nozzles onto the rolls and the product at the entry side of the mill. At the exit side of the stad, manifolds are connected to a transfer passage that leads to a liquid trap. Upstream from the liquid trap is a mist trap which has an exit air passage connected to a blower. The blower provides suction to positively withdraw coolant and air through the manifolds from around the rolled product. After removal of coolant, the remaining air or gas which is removed by the suction pump may then be discharged to the atmosphere without adversely impacting the environment. Doctor blades and air knives further enhance coolant removal from the rolls and the product. All the collected coolant is directed into the sump or reservoir for the stand. The duct work passages associated with the coolant removal system include sensors and are connected with a carbon dioxide gas supply that operates to suppress combustion of coolant or other material entrained in the duct work passages of the system.

Thus, it is an object of the invention to provide an improved method for positively removing coolant from a cold working roll stand.

Still another object of the invention is to provide an assembly which positively removes coolant from a cold working roll stand.

A further object of the present invention is to provide an assembly for removal of coolant from a roll that collects the coolant for recycling of the coolant.

Still another object of the invention is to provide a coolant removal system which also incorporates combustion suppression equipment to suppress the combustion of coolant.

Still another object of the invention is to provide a coolant removal system which is environmentally desirable in that it effects removal of potential pollutants from the air and gas stream that is discharged into the atmosphere by the coolant removal assembly.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
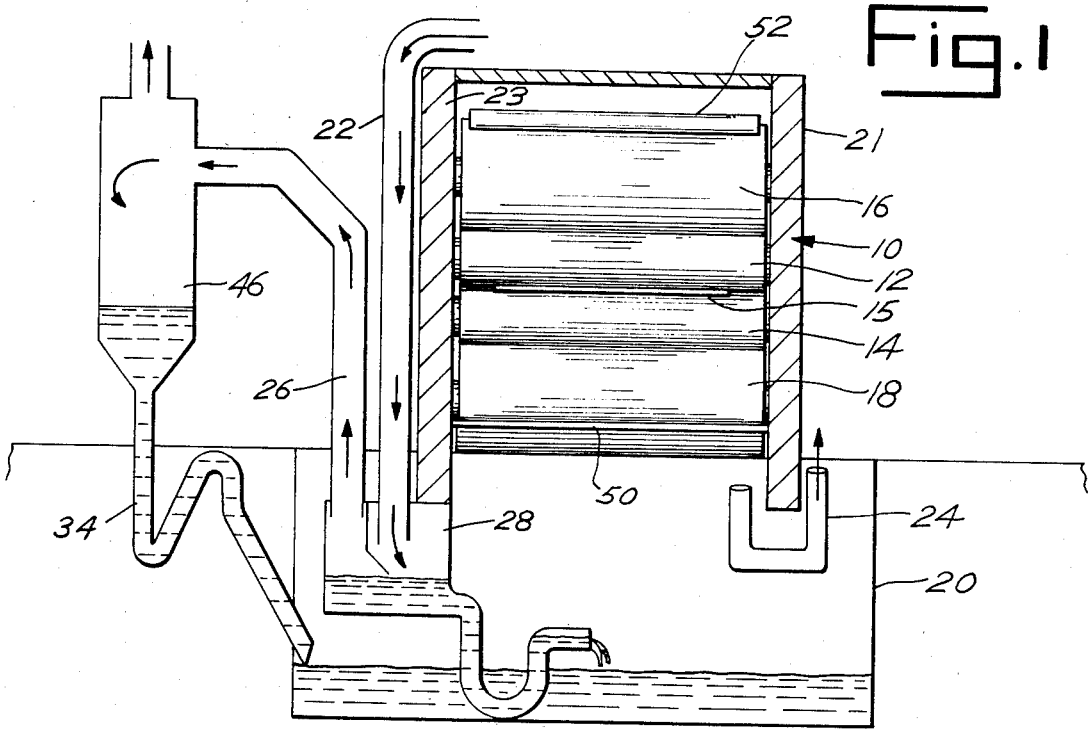
FIG. 1 is a schematic elevation of the system of the invention as incorporated in a typical mill stand.
Figure 2:
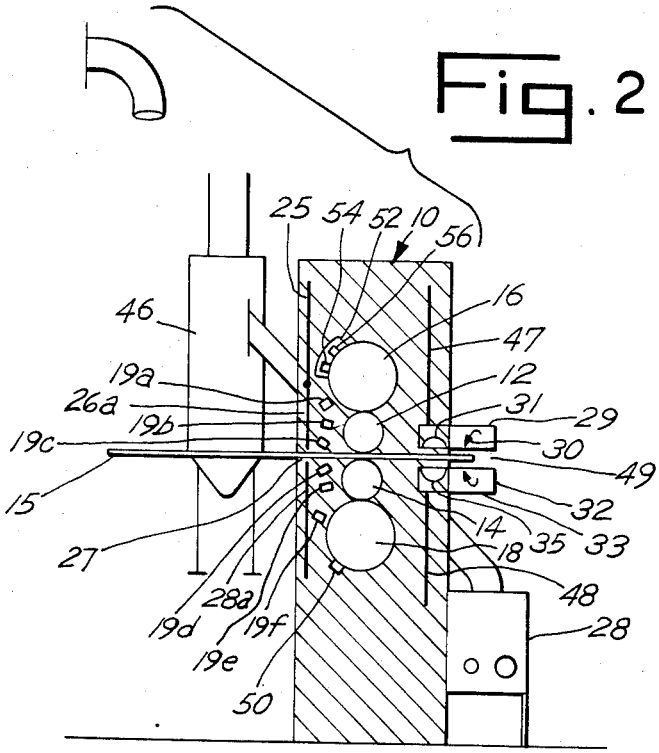
FIG. 2 is a schematic side elevation view of the roll stand of FIG. 1.
Figure 3:
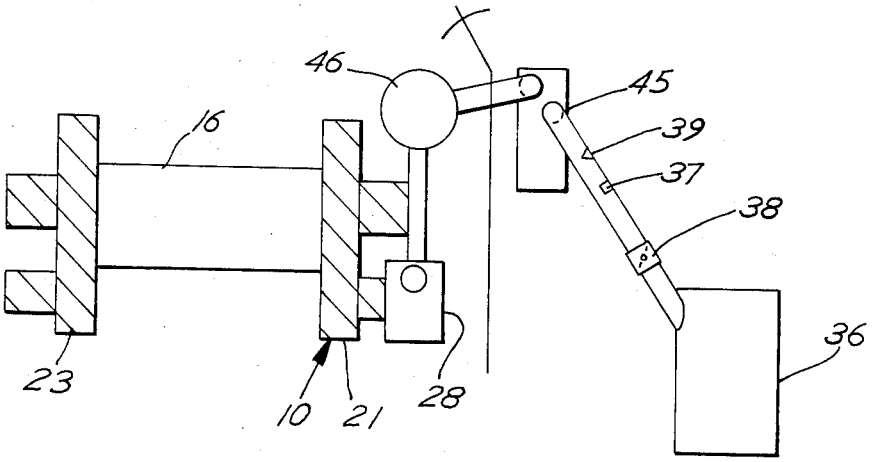
FIG. 3 is a top plan view of the system of FIG. 1.

The drawings schematically illustrate a typical rolling mill for aluminum or the like. The rolling mill includes a four high roll stand 10 having a top work roll 12 and a bottom work roll 14 in opposed relationship to define a pass line for a continuous sheet of material such as aluminum sheet 15. The rolls 12 and 14 are backed up by back-up rolls 16 and 18, respectively. The roll stand 10 may be configured like any one of those known in the art of cold rolling of aluminum or the like. Moreover, the invention is not limited to a four high stand nor a sheet rolling stand. The invention may be used in combination with any roll stand.

The roll stand 10 includes six stations of coolant or lubricant discharge nozzles **19*a*-19*f* to discharge coolant respectively upon the top and bottom of a sheet 15 of rolled material as it passes between the work rolls 12 and 14 as well as upon the rolls 12, 14, 16 and 18. The entire roll stand 10 is positioned over a mill sump or reservoir 20. Of course, the mill sump 20 is positioned beneath the roll stand and extends the length of the stand 10 so as to catch all fluid draining from the stand 10. The sides 21, 23 of the roll stand 10 limit the side spray of the coolant material when it is discharged by the nozzles. At the inlet side of the roll stand 10, a fixed upper shround 25 with a hinged shround plate 26*a* and a fixed lower shroud 28*a* define a slit 27 for passage of the aluminum sheet 15. The shrouds 25, 26*a* 28*a* prevent outward flow of coolant spray during the rolling operation and thus prevent splatter and loss of coolant from the roll stand 10 at the inlet side to the work rolls 12 and 14**.

At the top side of sheet 15 on the outlet side of the roll stand 10, a special suction box and air discharge nozzle assembly 29 directs an air flow onto the exiting sheet 15. The assembly 29 includes an air discharge knife or nozzle 30 and a suction box 31 which extends across the top surface of the rolled sheet 15 as it exits from between the work rolls 12 and 14. A similar assembly 32 is located at the bottom side of sheet 15 and includes nozzle 33 and suction box 35 positioned adjacent the bottom surface of exiting sheet in opposed relation to assembly 29. The specific construction of each box assembly 29, 32, is, on information and belief, the subject of a separate patent application assigned to Wean United, Inc., Pittsburgh, Pa.

The exit side of the mill stand 10 also includes shrouds 47, 48, which extend upwardly and downwardly from box assemblies 29, 32 respectively to thereby enclose the exit of the stand. The assemblies 29, 32 thus define a narrow slit 49 for the rolled sheet 15 to pass through. An object of the system is to remove all coolant from the sheet 15 prior to exit through the slit 49.

The suction boxes 31, 35 are connected by lines 22 and 24 to a single exhaust passage 26 through a liquid trap 28. Air and coolant mist which are drawn in through the lines 22 and 24 pass through the liquid trap 28. Liquid coolant entrained in the air flow is collected in the trap 28 and then flows into the mill sump 20.

The suction or flow through the passage 26 is effected by a blower 45 which draws the coolant laden air from the liquid trap 28 through the passage 26 into a cyclonic mist eliminator 46. Liquid mist is collected in the mist eliminator 46 and returns via a passage 34 to the sump 20. The discharge air is withdrawn by the blower 45 from the mist eliminator and ultimately is discharged through an exhaust hood 36.

A damper 38 is positioned in the line from the blower 45 to the exhaust hood 36. In the event a dangerous or combustible mixture of gas is monitored in the system by sensors, for example sensor 37, the damper 38 will close automatically.

Sensors 37 are placed at various positions in the pipes and passage from the mill stand 10 including in the suction boxes 31, 35 adjacent the pass line. The sensors 37 are responsive to combustible gas content in the pumped air. If combustion is sensed via heat sensors or gas content sensors, carbon dioxide is discharged through nozzles 39 into the pipes 22, 24 and passages 26 of the assembly. Also during the rolling operation, carbon dioxide may be discharged through nozzles 30, 33 associated with the suction boxes 31, 35. Thus, passage of carbon dioxide from the nozzles 30, 33 will impinge on the formed sheet 15 and cause the coolant moisture to flow more efficiently through the suction boxes 31, 35 while simultaneously serving to suppress combustion. Note that the carbon dioxide discharge system associated with the coolant removal system is separate from the normal carbon dioxde system associated with the roll stand 10. Preferably both systems are utilized and are interconnected so that initiation of one system automatically initiates operation of the other.

Another important feature of the invention is the use of doctor blades and air scrapers on the backup rolls 16, 18. Thus, lower backup roll 18 cooperates with a double doctor blade 50 made from Teflon polymer, for example, The double doctor blade 50 squeezes or removes coolant from roll 18 and diverts the fluid into sump 20.

In a similar fashion a special air knife and doctor blade assembly 52 cooperates with upper roll 16. Thus, an air knife 54 breaks up the fluid film on roll 16 and doctor blade 56 diverts the fluid into the sump 20. In a four high roll stand, the position of the double blade 50 has been found important. The double doctor blade 50 is positioned in the 7:00 to 8:00 position as depicted. Likewise, the position of the air knife and doctor blade assembly 52 is important and preferably is positioned at 10:00 as depicted in the figures.

Figure 4:
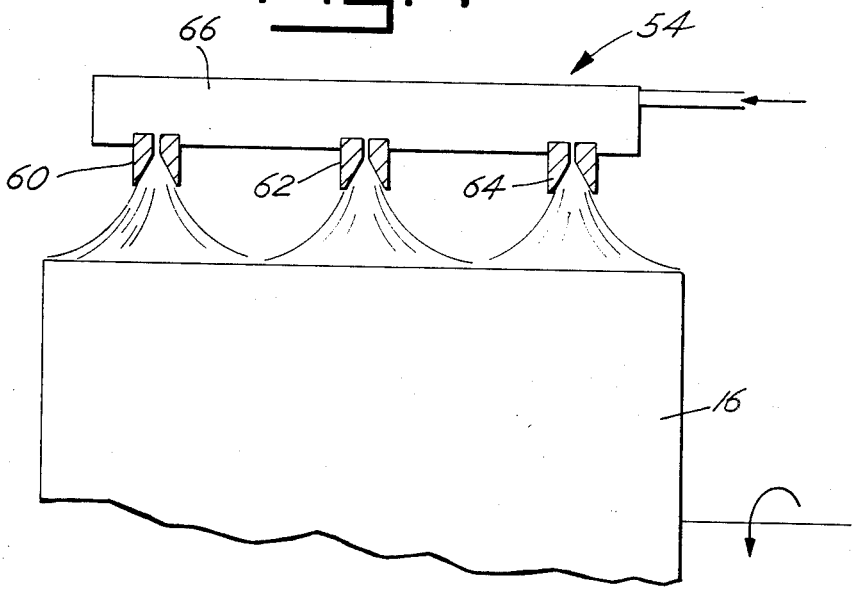
FIG. 4 is an enlarged view of a typical air knife incorporated in the invention.

All of the air knives may have a similar construction as shown in FIG. 4. That is, the knives are designed to direct coolant toward the outside edge of the rolls. In this manner coolant will collect and fall into the sump 20 or be more easily collected in collection boxes 31, 35. Knives thus may be comprised of three or more nozzles 60, 62, 64 arrayed transversely to the direction of movement of rolled product by attachment to a gas manifold 66. The middle nozzle 60 in the array will have a wide pattern and thus lower velocity whereas the side nozzles 62, 64 have increasingly higher velocity output to drive the coolant to the sides of the rolled product as depicted in FIG. 4.

In operation coolant is discharged onto the rolls 12, 14, 16, 18 and the formed metal sheet 15 at the entry side to the rolls from nozzles 19*a–f*. Excess coolant will flow and be collected by the mill sump 20. As the rolled metal passes from between the rolls 12, 14, an air mixture or a carbon dioxide flow of gas is impinged against the sheet 15. This causes the coolant to flow to the sump 20 or to form as a mist and be entrained in the gas. Simultaneously, the exhaust blower 45 is operated creating a suction in the suction boxes 31, 35 and cavity defined by the shrouds 47, 48 that surround the outlet side of the mill stand 10. Liquid and mist of the coolant is drawn into pipes and passages, and flows through traps to separate the liquid from the gas. Ultimately the gas is discharged to the atmosphere and the liquid collects in the sump 20.

Operation of the system without the blower 45 has been substantially as effective as with the blower 45 provided all doctor blades and doctor blade assemblies 50, 52 are being used and further provided that the air nozzles 30, 33 are utilized to disperse coolant from the sheet 15 so that the coolant will descend into the sump 20. Thus, the objective of the invention may be accomplished by use of shrouds 25, 26, 28, 47, 48, air nozzles and blades without suction of the blower 30.

Tests on a roll stand that did not incorporate the invention and using a kerosene based coolant initially showed 5.6 to 6.8 pounds of coolant are carried or discharged from the mill stand per 10,000 pounds of intermediate gauge aluminum foil stock that has been rolled. Subsequent to installation of the coolant removal system of the present invention, only 1.2 pounds of coolant per 10,000 pounds of aluminum coil were carried from the mill stand. Similarly with water based coolant, there was a drastic reduction in the amount of water based coolant that was transported with the rolled aluminum. Testing with water based coolant on rolled and annealed aluminum showed a residual amount of coolant in the amount of 0.30 milligrams per 288 square inches of rolled aluminum. Without the system of the present invention, 3.50 milligrams per 288 square inches of residual water base coolant were found.

Thus, the present invention provides significant savings of coolant and helps avoid staining or spotting of the rolled aluminum by the effective and efficient removal of the coolant. While there has been set forth a preferred embodiment of the invention, it is to be understood that the invention is limited only by the following claims and their equivalents.

What is claimed is:

1. A method for removing coolant liquid from a mill for cold rolling a nonferrous metal after the metal is formed, said mill of the type including a roll stand having a pair of opposed work rolls and an upper and lower backup roll in the stand for rolling metal as the metal passes between the work rolls, and liquid application means in the mill for applying liquid to the metal and rolls during rolling, said liquid application means being positioned upstream from the rolls, said method comprising the steps of:

applying liquid to the rolls and roll form with said liquid application means upstream of the rolls;

removing liquid from the rolls by impinging gas on at least one of said backup rolls on an entrance side of the mill;

removing liquid from the roll form by impinging gas on the roll form passing from the rolls at an exit side of the mill;

withdrawing a gas and liquid mixture from opposite sides of the metal roll form at an exit side of the mill and from the rolls subsequent to the gas impinging steps;

simultaneously at least partially enclosing the roll stand in a hood collection assembly comprising a plurality of shrouds for containing the gas and liquid mixture, said shrouds being positioned on the downstream side of the rolls on both sides of the roll form to define an exit slit for the roll form to pass therethrough during the gas impinging and withdrawal steps at the exit side of the mill;

transporting the withdrawn gas and liquid mixture to means for removing the liquid from the gas and liquid mixture;

removing the liquid from the mixture;

discharging the gas to the atmosphere; and, recycling the liquid into a sump for the roll stand for reuse as coolant liquid in the mill.

2. The method of claim 1, further including the step of enclosing the upstream side of the rolls in shrouds that define a metal entrance slit to the roll stand.

* * * * *